US010451984B2

(12) United States Patent
Mori et al.

(10) Patent No.: US 10,451,984 B2
(45) Date of Patent: Oct. 22, 2019

(54) PRODUCTION METHOD OF ELECTROPHOTOGRAPHIC PHOTOSENSITIVE MEMBER, ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Haruki Mori, Ichikawa (JP); Masaki Nonaka, Toride (JP); Shinji Takagi, Yokohama (JP); Koichi Nakata, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/969,836

(22) Filed: May 3, 2018

(65) Prior Publication Data

US 2018/0329317 A1 Nov. 15, 2018

(30) Foreign Application Priority Data

May 12, 2017 (JP) ..... 2017-095912

(51) Int. Cl.

| | |
|---|---|
| ***G03G 5/047*** | (2006.01) |
| ***G03G 5/147*** | (2006.01) |
| ***G03G 5/06*** | (2006.01) |
| ***G03G 5/05*** | (2006.01) |
| ***G03G 5/07*** | (2006.01) |
| *G03G 5/10* | (2006.01) |

(52) U.S. Cl.

CPC ..... *G03G 5/047* (2013.01); *G03G 5/0614* (2013.01); *G03G 5/0696* (2013.01); *G03G 5/071* (2013.01); *G03G 5/14786* (2013.01); *G03G 5/14795* (2013.01); *G03G 5/0564* (2013.01); *G03G 5/102* (2013.01); *G03G 2215/00957* (2013.01)

(58) Field of Classification Search

CPC ..... G03G 5/047; G03G 5/071; G03G 5/0696; G03G 5/0564; G03G 2215/00957; G03G 5/102

See application file for complete search history.

(56) References Cited

U.S. PATENT DOCUMENTS

| | | | |
|---|---|---|---|
| 7,333,752 | B2 | 2/2008 | Kawahara et al. |
| 7,732,113 | B2 | 6/2010 | Nakamura et al. |
| 7,910,274 | B2 | 3/2011 | Tanaka et al. |
| 8,088,541 | B2 | 1/2012 | Tanaka et al. |

(Continued)

FOREIGN PATENT DOCUMENTS

| | | |
|---|---|---|
| JP | 2000-66425 A | 3/2000 |
| JP | 2013-56956 A | 3/2013 |

(Continued)

OTHER PUBLICATIONS

U.S. Appl. No. 15/980,806, Koichi Nakata, filed May 16, 2018.

*Primary Examiner* — Thorl Chea

(74) *Attorney, Agent, or Firm* — Venable LLP

(57) ABSTRACT

A coating film of a coating liquid for a surface layer, the coating liquid containing a hole transporting compound having a chain-polymerizable functional group and a compound having a specified structure, is cured to thereby form a surface layer of an electrophotographic photosensitive member.

8 Claims, 3 Drawing Sheets

(56) References Cited

U.S. PATENT DOCUMENTS

| | | | | |
|---|---|---|---|---|
| 8,343,699 | B2 | 1/2013 | Nagasaka et al. | |
| 8,415,078 | B2 | 4/2013 | Tanaka et al. | |
| 8,465,889 | B2 | 6/2013 | Sekido et al. | |
| 8,524,430 | B2 | 9/2013 | Takagi et al. | |
| 8,524,433 | B2 * | 9/2013 | Doi | G03G 21/18 430/56 |
| 8,546,050 | B2 | 10/2013 | Maruyama et al. | |
| 8,632,931 | B2 | 1/2014 | Sekido et al. | |
| 8,783,209 | B2 | 7/2014 | Kaku et al. | |
| 8,795,936 | B2 | 8/2014 | Sekido et al. | |
| 9,244,369 | B2 | 1/2016 | Tanaka et al. | |
| 9,316,931 | B2 | 4/2016 | Takagi et al. | |
| 9,389,523 | B2 | 7/2016 | Nakata et al. | |
| 9,594,318 | B2 | 3/2017 | Nakata et al. | |
| 9,740,117 | B2 | 8/2017 | Kosaka et al. | |
| 2007/0042281 | A1 * | 2/2007 | Orito | G03G 5/0696 430/59.5 |
| 2017/0299971 | A1 | 10/2017 | Mori et al. | |
| 2017/0364025 | A1 | 12/2017 | Nakata et al. | |

FOREIGN PATENT DOCUMENTS

| | | | |
|---|---|---|---|
| JP | 2013-246307 | A | 12/2013 |
| JP | 2016-90593 | A | 5/2016 |
| JP | 2016-161698 | A | 9/2016 |

* cited by examiner

PRODUCTION METHOD OF ELECTROPHOTOGRAPHIC PHOTOSENSITIVE MEMBER, ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to a production method of electrophotographic photosensitive member, an electrophotographic photosensitive member, and a process cartridge and an electrophotographic apparatus including the electrophotographic photosensitive member.

Description of the Related Art

An electrophotographic photosensitive member to be mounted to an electrophotographic apparatus includes an organic electrophotographic photosensitive member (hereinafter, referred to as "electrophotographic photosensitive member") containing an organic photo-conductive material (charge generation material), and such an electrophotographic photosensitive member has been heretofore widely studied. In recent years, the electrophotographic photosensitive member has been demanded to be enhanced in durability, and a technique for allowing a surface layer of the electrophotographic photosensitive member to contain a cured product obtained by polymerization of a compound having a chain-polymerizable functional group is known (Japanese Patent Application Laid-Open No. 2000-66425).

While the electrophotographic photosensitive member using such a technique is enhanced in durability, the electrophotographic photosensitive member is problematic in terms of image quality in repeated use. In particular, the electrophotographic photosensitive member has the problems of streak-shaped image defects (image streaks) occurring due to insufficient lubricity of the surface of the electrophotographic photosensitive member and image defects (image smearings) occurring due to attachment of moisture onto the surface of the electrophotographic photosensitive member under a high-humidity environment. Therefore, techniques for improvements in the material and physical properties of the surface of the electrophotographic photosensitive member have been recently studied. Japanese Patent Application Laid-Open No. 2013-246307, Japanese Patent Application Laid-Open No. 2016-90593 and Japanese Patent Application Laid-Open No. 2016-161698 each describe an electrophotographic photosensitive member in which a compound having a long-chain alkyl group is contained in a surface layer, and such an electrophotographic photosensitive member is suppressed in image streaks occurring due to deterioration in lubricity of the surface of the electrophotographic photosensitive member in repeated use.

SUMMARY OF THE INVENTION

The above objects are achieved by the following present invention. That is, the method for producing an electrophotographic photosensitive member according to one aspect of the present invention is an electrophotographic photosensitive member production method for producing an electrophotographic photosensitive member including a support and a surface layer provided on the support, the production method including preparing a coating liquid for a surface layer, the coating liquid containing a hole transporting compound having a chain-polymerizable functional group and a compound represented by the following formula (1), and forming a coating film of the coating liquid for a surface layer and curing the coating film to thereby form a surface layer:

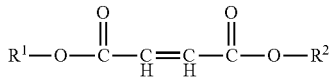

(1)

wherein $R^1$ and $R^2$ each represent a linear or branched alkyl group having 10 or more carbon atoms.

In addition, the electrophotographic photosensitive member according to another aspect of the present invention is an electrophotographic photosensitive member including a support and a photosensitive layer, wherein a surface layer of the electrophotographic photosensitive member includes a copolymerized product of a hole transporting compound having a chain-polymerizable functional group with a compound represented by the following formula (1):

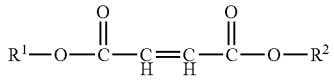

(1)

wherein $R^1$ and $R^2$ each represent a linear or branched alkyl group having 10 or more carbon atoms.

In addition, the process cartridge according to further aspect of the present invention integrally supports the electrophotographic photosensitive member, and at least one unit selected from the group consisting of a charging unit, a developing unit, a transfer unit and a cleaning unit, and is detachably attachable to a main body of an electrophotographic apparatus.

In addition, the electrophotographic apparatus according to further aspect of the present invention includes the electrophotographic photosensitive member, and a charging unit, an exposure unit, a developing unit and a transfer unit.

According to the present invention, an electrophotographic photosensitive member production method and an electrophotographic photosensitive member can be provided which allow for suppression of image streaks and image smearings and exhibition of good electrical characteristics where the change in image density due to the potential variation is suppressed, from the initial stage of use to the time of repeated use. In addition, according to the present invention, a process cartridge and an electrophotographic apparatus including the electrophotographic photosensitive member can be provided.

Further features of the present invention will become apparent from the following description of exemplary embodiments with reference to the attached drawings.

DESCRIPTION OF THE EMBODIMENTS

Figure 1:
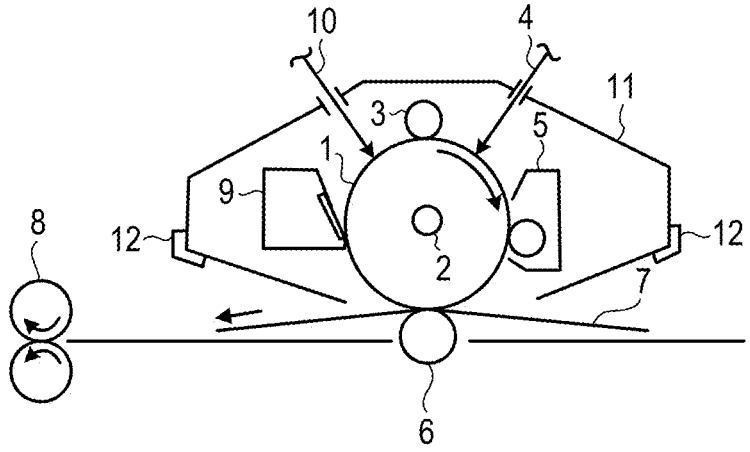
FIG. 1 is a view illustrating one schematic configuration example of an electrophotographic apparatus provided with a process cartridge including an electrophotographic photosensitive member of the present invention.

Preferred embodiments of the present invention will now be described in detail in accordance with the accompanying drawings.

According to studies by the present inventors, the electrophotographic photosensitive members described in Japanese Patent Application Laid-Open No. 2013-246307, Japanese Patent Application Laid-Open No. 2016-90593 and Japanese Patent Application Laid-Open No. 2016-161698 have caused the change in image density due to the potential variation to occur in repeated use. Therefore, such electrophotographic photosensitive members have a challenge in exhibiting stable and good electrical characteristics from the initial stage of use to the time of repeated use. Accordingly, an object of the present invention is to provide an electrophotographic photosensitive member production method and an electrophotographic photosensitive member in which image streaks and image smearings are suppressed and good electrical characteristics are exhibited from the initial stage of use to the time of repeated use. Furthermore, another object of the present invention is to provide a process cartridge and an electrophotographic apparatus including the electrophotographic photosensitive member.

Hereinafter, the present invention is described in detail with reference to suitable embodiments.

The electrophotographic photosensitive member production method of the present invention is an electrophotographic photosensitive member production method for producing an electrophotographic photosensitive member including a support and a surface layer provided on the support, the production method including preparing a coating liquid for a surface layer, the coating liquid containing a hole transporting compound having a chain-polymerizable functional group and a compound represented by the following formula (1), and forming a coating film of the coating liquid for a surface layer and curing the coating film to thereby form a surface layer:

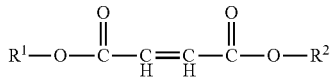

(1)

wherein $R^1$ and $R^2$ each represent a linear or branched alkyl group having 10 or more carbon atoms.

The present inventors presume the reason why the effect of the present invention is exerted due to inclusion of the above configuration, as follows.

It is presumed that image streaks occurring in repeated use of an electrophotographic photosensitive member are due to fusion of a toner and the like onto the surface of the electrophotographic photosensitive member and thus an unstable behavior of a cleaning unit (cleaning blade or the like). In addition, it is presumed that image smearings occurring in repeated use are due to attachment of moisture onto the surface of an electrophotographic photosensitive member degraded by the influence of discharge and thus reduction in the resistance of the electrophotographic photosensitive member surface and the inability of a latent image to be kept.

In the electrophotographic photosensitive member described in Japanese Patent Application Laid-Open No. 2013-246307, a surface layer of the electrophotographic photosensitive member contains a di-long-chain alkyl benzenedicarboxylate compound. It is considered that lubricity of the electrophotographic photosensitive member surface is enhanced by the influence of a long-chain alkyl group and a behavior of a cleaning unit is stabilized to suppress the occurrence of image streaks. It is also considered that hydrophobicity of the electrophotographic photosensitive member surface is enhanced again by the influence of a long-chain alkyl group and attachment of moisture is suppressed to suppress the occurrence of image smearings. The di-long-chain alkyl benzenedicarboxylate compound, however, is scraped off by the cleaning unit, and therefore the occurrence of image streaks and image smearings is not sufficiently suppressed in repeated use.

In each of the electrophotographic photosensitive members described in Japanese Patent Application Laid-Open No. 2016-90593 and Japanese Patent Application Laid-Open No. 2016-161698, a surface layer of the electrophotographic photosensitive member contains a long-chain alkyl acrylate compound. Such a compound has an acryloyloxy group or a methacryloyloxy group having chain polymerizability. Therefore, it is considered that the long-chain alkyl acrylate compound can be incorporated in a crosslinked structure constituting the surface layer and be present into the inside in the depth direction of the surface layer, and thus the long-chain alkyl acrylate compound is not completely scraped off by the cleaning unit even in repeated use and the occurrence of image streaks and image smearings are sufficiently suppressed.

On the other hand, such electrophotographic photosensitive members cause the change in image density due to the potential variation in repeated use. The potential variation in repeated use is presumed to be generated due to charge retention in the surface layer. The di-long-chain alkyl benzenedicarboxylate compound described in Japanese Patent Application Laid-Open No. 2013-246307 has π-π interaction in a benzene ring, and thus aggregates in the surface layer. Such an aggregate has no hole transporting property, and therefore is considered to cause charge retention in the surface layer. In addition, the long-chain alkyl acrylate compound described in each of Japanese Patent Application Laid-Open No. 2016-90593 and Japanese Patent Application Laid-Open No. 2016-161698 undergoes progression of even a mutual polymerization reaction of the long-chain alkyl acrylate compound in curing of the surface layer, thereby producing a polymerized product of the long-chain alkyl acrylate compound. The polymerized product has no hole transporting property, and thus is considered to cause charge retention in the surface layer.

The compound represented by the formula (1) adopted in the present application, however, has two linear or branched alkyl groups (long-chain alkyl groups) having 10 or more carbon atoms. Therefore, lubricity and hydrophobicity of the electrophotographic photosensitive member surface can be enhanced to suppress the occurrence of image streaks and image smearings. Furthermore, the compound represented by the formula (1) has a fumaric acid ester structure represented by the following formula (1-1) and a maleic acid ester structure represented by the following formula (1-2), having chain polymerizability. Therefore, the compound is incorporated in a crosslinked structure of the hole transporting compound having a chain-polymerizable functional group in curing of the surface layer and is not completely scraped off by the cleaning unit even in repeated use, and the occurrence of image streaks and image smearings can be suppressed.

(1-1)

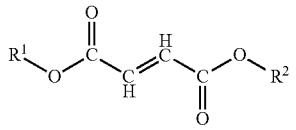

(1-2)

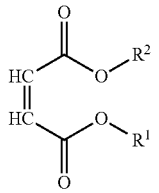

(in the formula (1-1) and formula (1-2), $R^1$ and $R^2$ each represent a linear or branched alkyl group having 10 or more carbon atoms.)

Furthermore, a fumaric acid ester compound and a maleic acid ester compound have specific polymerizability where homopolymerization does not almost occur and copolymerization with other chain-polymerizable functional group occurs. Therefore, mutual homopolymerization of the compound represented by the formula (1) does not almost occur and copolymerization of the compound represented by the formula (1) with the hole transporting compound having a chain-polymerizable functional group occurs in curing of the surface layer. Accordingly, a polymerized product of the compound represented by the formula (1) is not almost produced and charge retention in the surface layer is not caused, and therefore the potential variation in repeated use can be suppressed.

The above mechanism enables the effect of the present invention to be achieved.

In the present invention, the chain-polymerizable functional group means a functional group capable of chain polymerization, and the chain polymerization refers to, when a production reaction of a polymer compound is roughly classified to chain polymerization and sequential polymerization, the former polymerization reaction form. A structure having a vinyl group, or the like, corresponds to the chain-polymerizable functional group, and specific examples thereof include a vinyl group, an acryloyloxy group, a methacryloyloxy group, a vinyl carboxylate group and a styryl group.

$R^1$ and $R^2$ in the compound represented by the formula (1) each represent a linear or branched alkyl group having 10 or more carbon atoms. When $R^1$ and $R^2$ each represent a linear or branched alkyl group having 9 or less carbon atoms, lubricity and hydrophobicity of the electrophotographic photosensitive member surface are insufficient and the suppressive effect on image streaks and image smearings is not sufficiently achieved. $R^1$ and $R^2$ can each represent a linear or branched alkyl group having 10 or more and 19 or less carbon atoms, and in such a case, better electrical characteristics are achieved.

The compound represented by the formula (1) can be synthesized by using any synthesis method described in, for example, Japanese Patent Application Laid-Open No. 2013-56956.

While the compound represented by the formula (1) includes two structural isomers of a trans form (fumaric acid ester) and a cis form (maleic acid ester), the same effect can be achieved by any of the structural isomers in the present invention.

Specific examples (exemplary compounds) of the compound represented by the formula (1) include the following, but the present invention is not intended to be limited thereto.

TABLE1

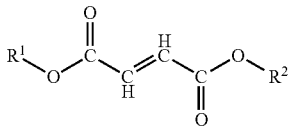

| Exemplary compound | $R^1$ | $R^2$ |
|---|---|---|
| (No. 1) | n-$C_{10}H_{21}$ | n-$C_{10}H_{21}$ |
| (No. 2) | n-$C_{12}H_{25}$ | n-$C_{12}H_{25}$ |
| (No. 3) | n-$C_{18}H_{37}$ | n-$C_{18}H_{37}$ |
| (No. 4) | n-$C_{20}H_{41}$ | n-$C_{20}H_{41}$ |
| (No. 5) | n-$C_{24}H_{49}$ | n-$C_{24}H_{49}$ |
| (No. 6) | n-$C_{10}H_{21}$ | n-$C_{20}H_{41}$ |
| (No. 7) | n-$C_{12}H_{25}$ | n-$C_{24}H_{49}$ |
| (No. 8) | iso-$C_{10}H_{21}$ | iso-$C_{10}H_{21}$ |
| (No. 9) | iso-$C_{18}H_{37}$ | iso-$C_{18}H_{37}$ |

TABLE 2

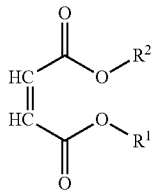

| Exemplary compound | $R^1$ | $R^2$ |
|---|---|---|
| (No. 10) | n-$C_{10}H_{21}$ | n-$C_{10}H_{21}$ |
| (No. 11) | n-$C_{12}H_{25}$ | n-$C_{12}H_{25}$ |
| (No. 12) | n-$C_{18}H_{37}$ | n-$C_{18}H_{37}$ |
| (No. 13) | n-$C_{20}H_{41}$ | n-$C_{20}H_{41}$ |
| (No. 14) | n-$C_{24}H_{49}$ | n-$C_{24}H_{49}$ |
| (No. 15) | n-$C_{10}H_{21}$ | n-$C_{20}H_{41}$ |
| (No. 16) | n-$C_{12}H_{25}$ | n-$C_{24}H_{49}$ |
| (No. 17) | iso-$C_{10}H_{21}$ | iso-$C_{10}H_{21}$ |
| (No. 18) | iso-$C_{18}H_{37}$ | iso-$C_{18}H_{37}$ |

The hole transporting compound having a chain-polymerizable functional group, constituting the copolymerized product with the compound represented by the formula (1), can be a compound represented by the following formula (2):

$$(P^1)_a A \quad (2)$$

wherein $P^1$ represents a monovalent functional group represented by the following formula (3) or the following formula (4).

(3)

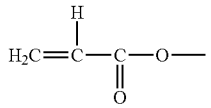

(4)

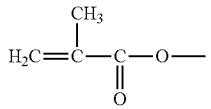

wherein a represents an integer of 2 or more and 4 or less, in which a number a of $P^1$ may be the same or different; A represents a hole transporting group, and a hydrogenated product in which a binding moiety of A and $P^1$ is replaced with a hydrogen atom is a compound represented by the following formula (5) or the following formula (6):

(5)

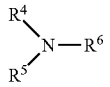

wherein $R^4$, $R^5$ and $R^6$ represent a phenyl group optionally having, as a substituent, an alkyl group having 1 or more and 6 or less carbon atoms; and $R^4$, $R^5$ and $R^6$ may be each the same or different; and (6)

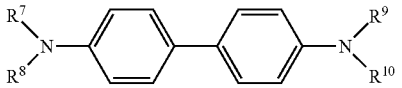

wherein $R^7$, $R^8$, $R^9$ and $R^{10}$ represent a phenyl group optionally having, as a substituent, an alkyl group having 1 or more and 6 or less carbon atoms; and $R^7$, $R^8$, $R^9$ and $R^{10}$ may be each the same or different.

The compound represented by the formula (2) has, as a chain-polymerizable functional group, an acryloyloxy group or a methacryloyloxy group. The compound represented by the formula (1) is decreased in homopolymerizability in curing of the surface layer, and thus better electrical characteristics are achieved. In addition, a in the formula (2) can be an integer of 2 or more and 4 or less. If a represents 1, a cured state is generated where a dense crosslinked structure is hardly formed, and if a represents 5 or more, a cured state is generated where strain in the surface layer easily occurs due to cure shrinkage or the like, and thus the suppressive effect on the potential variation is not sufficiently achieved.

The surface layer may also contain additive(s) such as an antioxidant, an ultraviolet absorber, a plasticizer, a leveling agent, a lubricity imparting agent and an abrasion resistance improver. Specific examples include a hindered phenol compound, a hindered amine compound, a sulfur compound, a phosphorus compound, a benzophenone compound, a siloxane-modified resin, silicone oil, a fluororesin particle, a polystyrene resin particle, a polyethylene resin particle, a silica particle, an alumina particle and a boron nitride particle.

The thickness of the surface layer is preferably 0.1 μm or more and 15 μm or less. Furthermore, the thickness is more preferably 0.5 μm or more and 10 μm or less.

A solvent that does not dissolve any layer provided under the surface layer is preferably used as the solvent for use in preparation of the coating liquid for a surface layer. An alcohol-based solvent such as methanol, ethanol, propanol, isopropanol, 1-butanol, 2-butanol or 1-methoxy-2-propanol is more preferable.

Examples of the coating method for forming the coating film of the coating liquid for a surface layer include dip-coating, spray coating, inkjet coating, roll coating, die coating, blade coating, curtain coating, wire bar coating and ring coating. In particular, dip-coating can be adopted in terms of efficiency and productivity.

The method for curing the coating film of the coating liquid for a surface layer includes a curing method by heat, ultraviolet light or an electron beam. The coating film can be cured by use of ultraviolet light or an electron beam in order to maintain strength of the surface layer and durability of the electrophotographic photosensitive member.

Polymerization can be performed by use of an electron beam because a very dense (high density) cured product (three-dimensional crosslinked structure) is obtained and a surface layer having higher durability is obtained. In irradiation with an electron beam, examples of an accelerator include scanning type, electrocurtain type, broad beam type, pulse type and laminar type accelerators.

When an electron beam is used, the acceleration voltage of the electron beam can be 120 kV or less from the viewpoint that degradation of material characteristics by the electron beam can be suppressed without any loss of polymerization efficiency. The dose of the electron beam absorbed on the surface of the coating film of the coating liquid for a surface layer is preferably 1 kGy or more and 50 kGy or less, more preferably 5 kGy or more and 10 kGy or less.

When the coating film is cured (subjected to polymerization) by use of an electron beam, the coating film can be irradiated with an electron beam in an inert gas atmosphere and thereafter heated in an inert gas atmosphere in order to suppress the polymerization inhibition action by oxygen. Examples of the inert gas include nitrogen, argon and helium.

The electrophotographic photosensitive member can be irradiated with ultraviolet light or an electron beam and thereafter heated to 100° C. or more and 170° C. or less. Thus, a surface layer having further high durability and suppressed image defects is obtained.

Next, a configuration of the electrophotographic photosensitive member of the present invention is described. In addition, respective components of the electrophotographic photosensitive member are described and the production methods thereof are also described.

[Electrophotographic Photosensitive Member]

The electrophotographic photosensitive member of the present invention includes a support, a photosensitive layer and a surface layer (protection layer) in the listed order.

Figure 2:
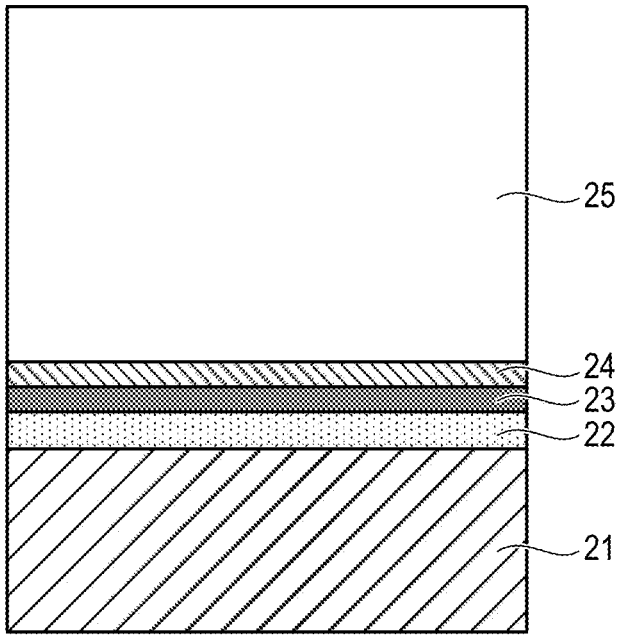
FIG. 2 is a view for describing one layer configuration example of an electrophotographic photosensitive member of the present invention.

FIG. 2 is a view illustrating one layer configuration example of the electrophotographic photosensitive member. In FIG. 2, the electrophotographic photosensitive member includes a support 21, an undercoat layer 22, a charge generation layer 23, a charge transport layer 24 and a protection layer 25. In such a case, the charge generation layer 23 and the charge transport layer 24 constitute the photosensitive layer, and the protection layer 25 corresponds to the surface layer.

Examples of the method for producing the electrophotographic photosensitive member of the present invention include a method where a coating liquid for each layer, described below, is prepared and a desired layer is formed by coating in order and dried. Examples of the coating method here include the above coating methods, and dip-coating can be adopted in terms of efficiency and productivity.

Hereinafter, the support and each layer are described.

<Support>

In the present invention, the electrophotographic photosensitive member includes a support. In the present invention, the support can be an electro-conductive support having electro-conductivity. Examples of the shape of the support include a cylindrical shape, a belt shape and a sheet shape. In particular, a cylindrical support can be adopted. The surface of the support may also be subjected to an electrochemical treatment such as anodization, or a blast treatment or a cutting treatment.

The material of the support can be a metal, a resin, glass or the like.

Examples of the metal include aluminum, iron, nickel, copper, gold, stainless steel and alloys thereof. In particular, an aluminum support using aluminum can be adopted.

The resin and the glass may have electro-conductivity imparted by a treatment such as mixing of or covering with an electro-conductive material.

<Electro-Conductive Layer>

In the present invention, an electro-conductive layer may also be provided on the support. The electro-conductive layer can be provided to thereby shield scarring and/or irregularities on the support surface and control reflection of light on the support surface.

The electro-conductive layer can contain an electro-conductive particle and a resin.

Examples of the material of the electro-conductive particle include a metal oxide, metal and carbon black. Examples of the metal oxide include zinc oxide, aluminum oxide, indium oxide, silicon oxide, zirconium oxide, tin oxide, titanium oxide, magnesium oxide, antimony oxide and bismuth oxide. Examples of the metal include aluminum, nickel, iron, nichrome, copper, zinc and silver.

In particular, the metal oxide is preferably used, and titanium oxide, tin oxide or zinc oxide is particularly preferably used, as the electro-conductive particle.

When the metal oxide is used in the electro-conductive particle, the surface of the metal oxide may be treated with a silane coupling agent or the like, or the metal oxide may be doped with an element such as phosphorus or aluminum, or an oxide thereof.

The electro-conductive particle may have a laminate configuration having a core particle and a covering layer with which the particle is covered. Examples of the core particle include titanium oxide, barium sulfate and zinc oxide. Examples of the covering layer include metal oxide such as tin oxide.

When the metal oxide is used as the electro-conductive particle, the volume average particle size thereof is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin and an alkyd resin.

The electro-conductive layer may further contain a masking agent such as silicone oil, a resin particle and titanium oxide.

The average thickness of the electro-conductive layer is preferably 1 μm or more and 50 μm or less, particularly preferably 3 μm or more and 40 μm or less.

The electro-conductive layer can be formed by preparing a coating liquid for an electro-conductive layer, the coating liquid containing the above respective materials and a solvent, forming a coating film of the coating liquid and drying the coating film. Examples of the solvent for use in the coating liquid include an alcohol-based solvent, a sulfoxide-based solvent, a ketone-based solvent, an ether-based solvent, an ester-based solvent and an aromatic hydrocarbon-based solvent. Examples of the method for dispersing the electro-conductive particle in the coating liquid for an electro-conductive layer include a method using a paint shaker, a sand mill, a ball mill or a liquid collision type high-speed disperser.

<Undercoat Layer>

In the present invention, an undercoat layer may be provided on the support or the electro-conductive layer. The undercoat layer can be provided, to thereby enhance an adhesion function between layers to impart a charge injection inhibition function.

The undercoat layer can contain a resin. The undercoat layer may also be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamideimide resin and a cellulose resin.

In the monomer having a polymerizable functional group, examples of the polymerizable functional group include an isocyanate group, a block isocyanate group, a methylol group, an alkylated methylol group, an epoxy group, a metal alkoxide group, a hydroxyl group, an amino group, a carboxyl group, a thiol group, a carboxylic anhydride group and a carbon-carbon double bond group.

The undercoat layer may further contain an electron transport material, a metal oxide, a metal, an electro-conductive polymer and the like for the purpose of enhancing electrical characteristics. In particular, an electron transport material and/or a metal oxide can be used.

Examples of the electron transport material include a quinone compound, an imide compound, a benzimidazole compound, a cyclopentadienylidene compound, a fluorenone compound, a xanthone compound, a benzophenone compound, a cyanovinyl compound, an aryl halide compound, a silole compound and a boron-containing compound. The undercoat layer can also be formed as a cured film by using, as the electron transport material, an electron transport material having a polymerizable functional group, and copolymerizing the electron transport material with the above monomer having a polymerizable functional group.

Examples of the metal oxide include indium tin oxide, tin oxide, indium oxide, titanium oxide, zinc oxide, aluminum oxide and silicon dioxide. Examples of the metal include gold, silver and aluminum.

The undercoat layer may further contain additive(s).

The average thickness of the undercoat layer is preferably 0.1 μm or more and 50 μm or less, more preferably 0.2 μm or more and 40 μm or less, particularly preferably 0.3 μm or more and 30 μm or less.

The undercoat layer can be formed by preparing a coating liquid for an undercoat layer, the coating liquid containing the above respective materials and a solvent, forming a coating film of the coating liquid, and drying and/or curing the coating film. Examples of the solvent for use in the coating liquid include an alcohol-based solvent, a ketone-based solvent, an ether-based solvent, an ester-based solvent and an aromatic hydrocarbon-based solvent.

<Photosensitive Layer>

The photosensitive layer of the electrophotographic photosensitive member is classified mainly to (1) a laminate type photosensitive layer and (2) a monolayer type photosensitive layer. The laminate type photosensitive layer (1) includes a charge generation layer containing a charge generation material and a charge transport layer containing a charge transport material. The monolayer type photosensitive layer (2) is a photosensitive layer containing both of a charge generation material and a charge transport material.

(1) Laminate Type Photosensitive Layer

The laminate type photosensitive layer includes a charge generation layer and a charge transport layer.

(1-1) Charge Generation Layer

The charge generation layer can contain a charge generation material and a resin.

Examples of the charge generation material include an azo pigment, a perylene pigment, a polycyclic quinone pigment, an indigo pigment and a phthalocyanine pigment. In particular, an azo pigment or a phthalocyanine pigment can be adopted. Among phthalocyanine pigments, an oxytitanium phthalocyanine pigment, a chlorogallium phthalocyanine pigment or a hydroxygallium phthalocyanine pigment can be adopted.

The content of the charge generation material in the charge generation layer is preferably 40% by mass or more and 85% by mass or less, more preferably 60% by mass or more and 80% by mass or less based on the total mass of the charge generation layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin and a polyvinyl chloride resin. In particular, a polyvinyl butyral resin is more preferable.

The charge generation layer may further contain additive(s) such as an antioxidant and an ultraviolet absorber. Specific examples include a hindered phenol compound, a hindered amine compound, a sulfur compound, a phosphorus compound and a benzophenone compound.

The average thickness of the charge generation layer is preferably 0.1 μm or more and 1 μm or less, more preferably 0.15 μm or more and 0.4 μm or less.

The charge generation layer can be formed by preparing a coating liquid for a charge generation layer, the coating liquid containing the above respective materials and a solvent, forming a coating film of the coating liquid and drying the coating film. Examples of the solvent for use in the coating liquid include an alcohol-based solvent, a sulfoxide-based solvent, a ketone-based solvent, an ether-based solvent, an ester-based solvent and an aromatic hydrocarbon-based solvent.

(1-2) Charge Transport Layer

The charge transport layer can contain a charge transport material and a resin.

Examples of the charge transport material include a polycyclic aromatic compound, a heterocyclic compound, a hydrazone compound, a styryl compound, an enamine compound, a benzidine compound, a triarylamine compound and resins having groups derived from such materials. In particular, a triarylamine compound or a benzidine compound can be adopted.

The content of the charge transport material in the charge transport layer is preferably 25% by mass or more and 70% by mass or less, more preferably 30% by mass or more and 55% by mass or less based on the total mass of the charge transport layer.

The resin can be a polyester resin, a polycarbonate resin, an acrylic resin or a polystyrene resin. In particular, a polycarbonate resin or a polyester resin can be adopted. The polyester resin is particularly preferably a polyarylate resin.

The content ratio of the charge transport material and the resin (mass ratio) is preferably 4:10 to 20:10, more preferably 5:10 to 12:10.

The charge transport layer may contain additive(s) such as an antioxidant, an ultraviolet absorber, a plasticizer, a leveling agent, a lubricity imparting agent and an abrasion resistance improver. Specific examples include a hindered phenol compound, a hindered amine compound, a sulfur compound, a phosphorus compound, a benzophenone compound, a siloxane-modified resin, silicone oil, a fluororesin particle, a polystyrene resin particle, a polyethylene resin particle, a silica particle, an alumina particle and a boron nitride particle.

The average thickness of the charge transport layer is preferably 5 μm or more and 50 μm or less, more preferably 8 μm or more and 40 μm or less, particularly preferably 10 μm or more and 30 μm or less.

The charge transport layer can be formed by preparing a coating liquid for a charge transport layer, the coating liquid containing the above respective materials and a solvent, forming a coating film of the coating liquid and drying the coating film. Examples of the solvent for use in the coating liquid include an alcohol-based solvent, a ketone-based solvent, an ether-based solvent, an ester-based solvent and an aromatic hydrocarbon-based solvent. Among such solvents, an ether-based solvent or an aromatic hydrocarbon-based solvent can be adopted.

(2) Monolayer Type Photosensitive Layer

The monolayer type photosensitive layer can be formed by preparing a coating liquid for a photosensitive layer, the coating liquid containing a charge generation material, a charge transport material, a resin and a solvent, forming a coating film of the coating liquid on the support or the electro-conductive layer, or the undercoat layer, and drying the coating film. The charge generation material, the charge transport material and the resin are the same as the materials in the "laminate type photosensitive layer (1)".

<Surface Layer (Protection Layer)>

The protection layer serving as the surface layer can be formed by preparing a coating liquid for a surface layer, and forming a coating film of the coating liquid for a surface layer on the photosensitive layer and curing the coating film to thereby form a surface layer, as described above.

[Method for Forming Concave Shape Portion on Surface of Electrophotographic Photosensitive Member]

A concave shape portion or a convex shape portion can be provided on the surface layer of the electrophotographic photosensitive member for the purpose of more stabilizing a behavior of a cleaning blade brought into contact with the electrophotographic photosensitive member.

The concave shape portion or the convex shape portion may be formed on the whole area or a part of the surface of the electrophotographic photosensitive member. When the concave shape portion or the convex shape portion is formed on a part of the surface of the electrophotographic photosensitive member, the concave shape portion or the convex shape portion can be formed on at least the whole area of a contact region with the cleaning blade.

When the concave shape portion is formed, a mold having a convex shape portion corresponding to a concave shape portion to be formed is contacted under pressure and shape transfer is performed to thereby form the concave shape portion.

Figure 3:
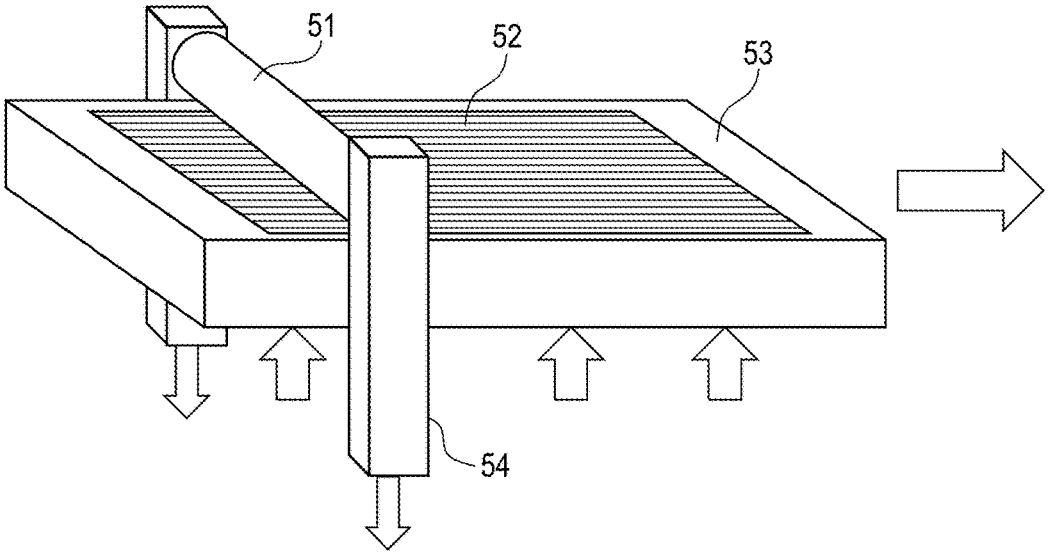
FIG. 3 is a view illustrating an example of a pressure-contact shape transfer/processing apparatus for forming a concave shape portion on the surface of an electrophotographic photosensitive member of the present invention.

FIG. 3 illustrates an example of a pressure-contact shape transfer/processing apparatus for forming the concave shape portion on the surface of the electrophotographic photosensitive member.

The pressure-contact shape transfer/processing apparatus illustrated in FIG. 3, while rotating an electrophotographic photosensitive member 51 as an object to be processed, can continuously bring a mold 52 into contact with the surface (periphery) of the electrophotographic photosensitive member, for pressurizing, thereby forming the concave shape portion and/or a flat portion on the surface of the electrophotographic photosensitive member 51.

Examples of the material of a pressure member 53 include a metal, a metal oxide, plastic and glass. In particular, stainless steel (SUS) can be adopted in terms of mechanical strength, dimension accuracy and durability. The pressure member 53, where the mold 52 is disposed on the upper surface, can bring the mold 52 into contact with the surface of the electrophotographic photosensitive member 51 supported by a support member 54, at a predetermined pressure, by a support member (not illustrated) and a pressure system (not illustrated) disposed on the lower surface. The support member 54 may be pushed onto the pressure member 53 at a predetermined pressure, or the support member 54 and the pressure member 53 may be pushed onto each other.

FIG. 3 illustrates an example where the pressure member 53 is moved in a direction perpendicular to the shaft direction of the electrophotographic photosensitive member 51, to thereby continuously process the surface of the electrophotographic photosensitive member 51, with the electrophotographic photosensitive member 51 being driven in response to such movement or rotated by driving. Furthermore, the pressure member 53 can be secured and the support member 54 can be moved in the direction perpendicular to the shaft direction of the electrophotographic photosensitive member 51, or both the support member 54 and the pressure member 53 can be moved to thereby continuously process the surface of the electrophotographic photosensitive member 51.

The mold 52 and the electrophotographic photosensitive member 51 can be heated from the viewpoint that shape transfer is efficiently performed.

Examples of the mold 52 include one where a metal, a resin film or a silicon wafer finely surface-processed is patterned by a resist, and one where a resin film with a fine particle dispersed therein or a resin film having a fine surface shape is coated with a metal.

An elastic member can be disposed between the mold 52 and the pressure member 53 from the viewpoint that the pressure for pushing onto the electrophotographic photosensitive member 51 is made uniform.

[Process Cartridge and Electrophotographic Apparatus]

The process cartridge of the present invention integrally supports the electrophotographic photosensitive member described above, and at least one unit selected from the group consisting of a charging unit, a developing unit, a transfer unit and a cleaning unit, and is detachably attachable to a main body of an electrophotographic apparatus.

The electrophotographic apparatus of the present invention includes the electrophotographic photosensitive member described above, and a charging unit, an exposure unit, a developing unit and a transfer unit.

FIG. 1 illustrates one schematic configuration example of an electrophotographic apparatus provided with a process cartridge including an electrophotographic photosensitive member.

Reference Numeral 1 represents a cylinder-shaped electrophotographic photosensitive member, and the electrophotographic photosensitive member is rotary-driven around a shaft 2 in an arrow direction at a predetermined peripheral velocity. The surface of the electrophotographic photosensitive member 1 is positively or negatively charged to have a predetermined potential by a charging unit 3. Although a roller charging system by a roller type charging member is illustrated in the drawing, a charging system such as a corona charging system, a proximity charging system or an injection charging system may also be adopted. The surface of the electrophotographic photosensitive member 1 charged is irradiated with exposure light 4 from an exposure unit (not illustrated), and an electrostatic latent image is formed thereon according to objective image information. The electrostatic latent image formed on the surface of the electrophotographic photosensitive member 1 is developed by a toner received in a developing unit 5, to form a toner image on the surface of the electrophotographic photosensitive member 1. The toner image formed on the surface of the electrophotographic photosensitive member 1 is transferred to a transfer material 7 by a transfer unit 6. The transfer material 7 to which the toner image is transferred is conveyed to a fixing unit 8, subjected to a fixing treatment of the toner image, and discharged outside the electrophotographic apparatus. The electrophotographic apparatus may include a cleaning unit 9 that removes an attached object such as a toner remaining on the surface of the electrophotographic photosensitive member 1 after transferring. Alternatively, no cleaning unit may be separately provided and a so-called cleanerless system that removes the attached object by a developing unit or the like may be used. The electrophotographic apparatus may include a neutralization mechanism that subjects the surface of the electrophotographic photosensitive member 1 to a neutralization treatment by pre-exposure light 10 from a pre-exposure unit (not illustrated). A guiding unit 12 such as a rail may also be provided in order to detachably attach the process cartridge 11 of the present invention to a main body of the electrophotographic apparatus.

The electrophotographic photosensitive member of the present invention can be used in a laser beam printer, an LED printer, a copier, a facsimile, a combined machine thereof and the like.

EXAMPLES

Hereinafter, the present invention is described in more detail with respect to Examples and Comparative Examples. The present invention is not intended to be limited to the following Examples at all without departing from the gist thereof. Herein, "part(s)" in the following Examples is on a mass basis unless particularly noted.

Example 1

An aluminum cylinder having a diameter of 30 mm, a length of 357.5 mm and a thickness of 1 mm was prepared as a support (electro-conductive support).

Next, 100 parts of a zinc oxide particle (specific surface area: 19 $m^2/g$, powder resistivity: $4.7\times10^6$ Ω·cm) and 500 parts of toluene were stirred and mixed, and 0.8 parts of a silane coupling agent was added thereto and stirred for 6 hours. Thereafter, toluene was distilled off under reduced pressure, and the resultant was heated and dried at 130° C. for 6 hours to provide a zinc oxide particle surface-treated. KBM602 (compound name: N-2-(aminoethyl)-3-aminopropylmethyldimethoxysilane) produced by Shin-Etsu Chemical Co., Ltd. was used as the silane coupling agent.

Next, 15 parts of a polyvinyl butyral resin (weight average molecular weight: 40000, trade name: BM-1, produced by Sekisui Chemical Co., Ltd.) as a polyol resin and 15 parts of blocked isocyanate (trade name: Sumidur 3175, produced by Sumika Covestro Urethane Co., Ltd. (former name: Sumika Bayer Urethane Co., Ltd.)) were dissolved in a mixed solution of 73.5 parts of methyl ethyl ketone and 73.5 parts of 1-butanol. The zinc oxide particle surface-treated (80.8 parts) and 0.8 parts of 2,3,4-trihydroxybenzophenone (produced by Tokyo Chemical Industry Co., Ltd.) were added to the solution, and dispersed by a sand mill apparatus using glass beads of 0.8 mm in diameter, under an atmosphere at 23±3° C. for 3 hours. After the dispersing, 0.01 parts of silicone oil (trade name: SH28PA, produced by Dow Corning Toray Co., Ltd.) and 5.6 parts of a crosslinked polymethylmethacrylate (PMMA) particle (trade name: TECHPOLYMER SSX-103, produced by Sekisui Plastic Co., Ltd., average primary particle size: 3 μm) were added and stirred to prepare a coating liquid for an undercoat layer.

The aluminum cylinder was dip-coated with the coating liquid for an undercoat layer to form a coating film, and the resulting coating film was dried at 160° C. for 40 minutes to form an undercoat layer having a thickness of 18 μm.

Next, a hydroxygallium phthalocyanine crystal of a crystal form having strong peaks at Bragg angles 20±0.2° of 7.4° and 28.2° in CuKα characteristic X-ray diffraction was prepared. Twenty parts of the hydroxygallium phthalocyanine crystal, 0.2 parts of a compound represented by the following formula (A), 10 parts of a polyvinyl butyral resin (trade name: S-Lec BX-1, produced by Sekisui Chemical Co., Ltd.) and 600 parts of cyclohexanone were dispersed by a sand mill apparatus using glass beads of 1 mm in diameter, for 4 hours. Thereafter, 700 parts of ethyl acetate was added to prepare a coating liquid for a charge generation layer. The undercoat layer was dip-coated with the coating liquid for a charge generation layer to form a coating film, and the resulting coating film was heated and dried in an oven at a temperature of 80° C. for 15 minutes to thereby form a charge generation layer having a thickness of 0.17 μm.

(A)

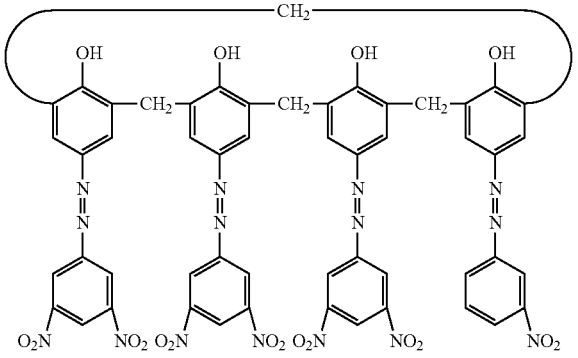

Next, 30 parts of a compound (charge transport material) represented by the following formula (B), 60 parts of a compound (charge transport material) represented by the following formula (C), 10 parts of a compound represented by the following formula (D), 100 parts of a polycarbonate resin (trade name: Iupilon Z400, produced by Mitsubishi Engineering-Plastics Corporation, bisphenol Z type) and 0.02 parts of polycarbonate (viscosity average molecular weight Mv: 20000) having a structural unit represented by the following formula (E) were dissolved in a solvent of 600 parts of mixed xylene and 200 parts of dimethoxymethane to thereby prepare a coating liquid for a charge transport layer. The charge generation layer was dip-coated with the coating liquid for a charge transport layer to form a coating film, and the resulting coating film was dried at 100° C. for 30 minutes to thereby form a charge transport layer having a thickness of 18 μm.

(B)

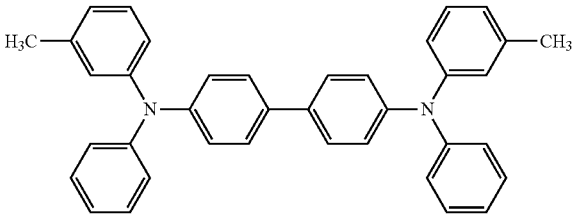

(C)

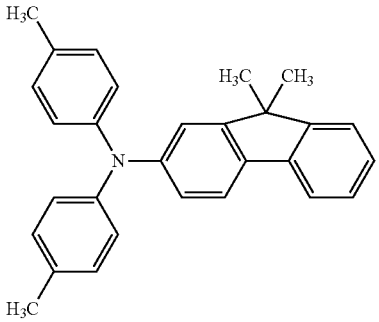

(D)

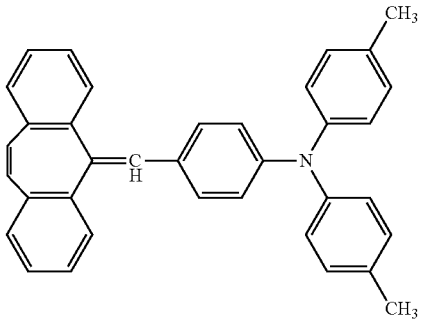

(E)

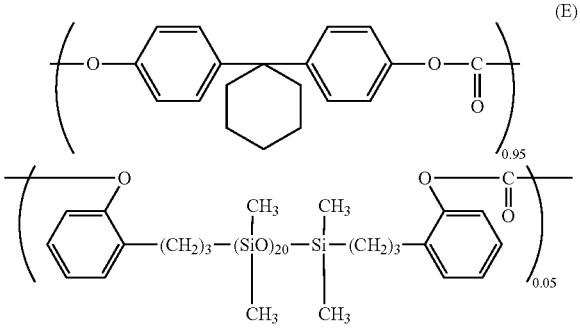

(in the formula (E), 0.95 and 0.05 mean the molar ratio between two structural units (copolymerization ratio).)

Next, 14 parts of exemplary compound (No. 1), 56 parts of a hole transporting compound represented by the following formula (F), 30 parts of a polytetrafluoroethylene particle (Ruburon L-2, produced by Daikin Industries, Ltd.), 1.5 parts of a fluorine atom-containing resin (trade name: GF400, produced by Toagosei Co., Ltd.), 100 parts of 1-propanol and 100 parts of 1,1,2,2,3,3,4-heptafluorocyclopentane (trade name: Zeorora H, produced by Zeon Corporation) were mixed, and thereafter the solution was subjected to a dispersion treatment by a super high speed disperser. Thereafter, the solution was filtered by a polyflon filter (trade name: PF-060, manufactured by Toyo Roshi Kaisha, Ltd.) to thereby prepare a coating liquid for a surface layer 1.

(F)

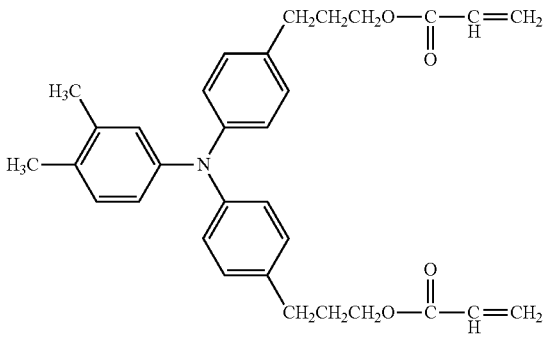

The charge transport layer was dip-coated with the coating liquid for a surface layer to form a coating film. The resulting coating film was dried at 50° C. for 5 minutes. Next, while a support (object to be irradiated) was rotated under a nitrogen atmosphere in conditions of an acceleration voltage of 70 kV and a beam current of 5.0 mA at a speed of 200 rpm, the coating film was irradiated with an electron beam for 1.6 seconds, and thereafter the temperature of the coating film was raised from 25° C. to 140° C. over 15 seconds to perform curing of the coating film. The dose of the electron beam absorbed was here measured and found to be 15 kGy, and the oxygen concentration from the irradiation with an electron beam to the subsequent heating treatment was 16 ppm or less. Next, the coating film was naturally cooled in the air until the temperature thereof was decreased to 25° C., and thereafter subjected to a heating treatment at 105° C. for 15 minutes to form a surface layer (protection layer) having a thickness of 5 μm.

Thus, an electrophotographic photosensitive member having the protection layer, before concave portion formation, was produced.

Next, a mold member (mold) was placed in a pressure-contact shape transfer/processing apparatus, and the produced electrophotographic photosensitive member before concave portion formation was surface-processed.

Figure 4A:
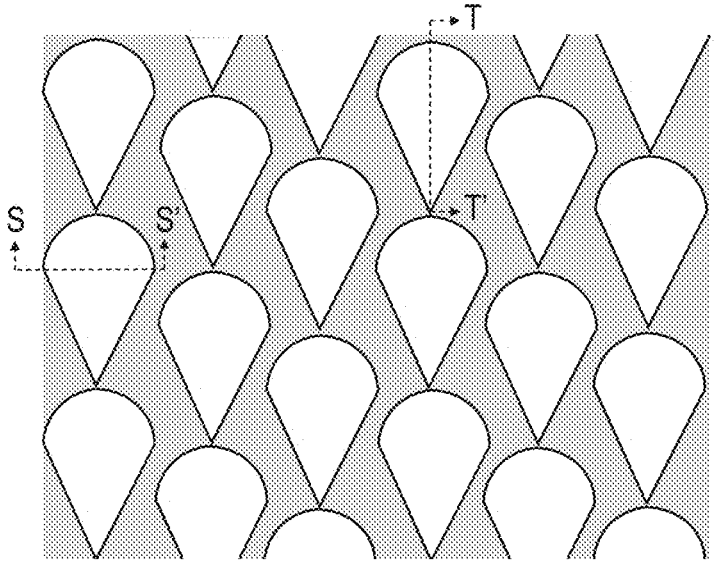
FIG. 4A is a top view and FIG. 4B and FIG. 4C are cross-sectional views illustrating a mold used in Examples and Comparative Examples of the present invention.
Figure 4B:
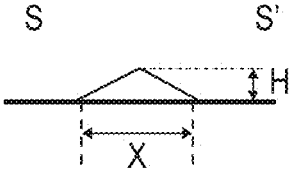
Figure 4C:
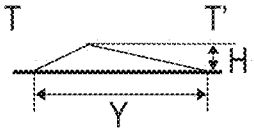

Specifically, a mold illustrated in FIGS. 4A to 4C were placed in a pressure-contact shape transfer/processing apparatus generally having a configuration illustrated in FIG. 3, and the produced electrophotographic photosensitive member before concave portion formation was surface-processed. FIGS. 4A to 4C are views illustrating a mold used in Examples and Comparative Examples, FIG. 4A is a top view schematically illustrating the mold, FIG. 4B is a schematic cross-sectional view (cross-sectional view of the S-S' cross-section in FIG. 4A) of the convex portion of the mold in the shaft direction of the electrophotographic photosensitive member, and FIG. 4C is a cross-sectional view (cross-sectional view of the T-T' cross-section in FIG. 4A) of the convex portion of the mold in the circumferential direction of the electrophotographic photosensitive member. The mold illustrated in FIGS. 4A to 4C has a convex shape having a maximum width (maximum width in the shaft direction of the electrophotographic photosensitive member when the convex portion on the mold is viewed from above) X of 50 μm, a maximum length (maximum length in the circumferential direction of the electrophotographic photosensitive member when the convex portion on the mold is viewed from above) Y of 75 μm, an area rate of 56% and a height H of 4 μm. The area rate here means the area rate of the convex portion in the entire surface when the mold is viewed from above. In processing, while the temperatures of the electrophotographic photosensitive member and the mold were controlled so that the temperature of the surface of the electrophotographic photosensitive member was 120° C., and the electrophotographic photosensitive member and a pressure member were pushed onto the mold at a pressure of 7.0 MPa, the electrophotographic photosensitive member was rotated in the circumferential direction to form a concave shape portion on the entire surface (periphery) of the surface layer of the electrophotographic photosensitive member. Thus, the electrophotographic photosensitive member was produced.

The surface of the resulting electrophotographic photosensitive member was magnified and observed by a laser microscope (manufactured by Keyence Corporation, trade name: X-100) with a 50-magnification lens, and the concave shape portion provided on the surface of the electrophotographic photosensitive member was observed. In such observation, adjustment was conducted so that no tilt in the longitudinal direction of the electrophotographic photosensitive member was made and focusing on the vertex of the circular arc of the electrophotographic photosensitive member was made in the circumferential direction. The image magnified and observed was connected by an image connection application to provide a square region 500 μm on a side. With respect to the results obtained, the height data, image-processed, was selected by the accompanying image analysis software and subjected to filter processing by a filter type median.

As a result of the observation, the depth of the concave shape portion was 2 μm, the width of the opening in the shaft direction was 50 μm, the length of the opening in the circumferential direction was 75 μm, and the area was 140000 $\mu m^2$. The area here corresponds to the area of the concave shape portion when the surface of the electrophotographic photosensitive member is viewed from above, and means the area of the opening of the concave shape portion.

The resulting electrophotographic photosensitive member was mounted to the cyan station of an altered machine of an electrophotographic apparatus (copier) (trade name: iR-ADV C5255) manufactured by Canon Inc., as an evaluation apparatus, and subjected to image evaluation in an environment of 30° C. and 80% RH.

The image evaluation was performed as follows. The total amount of the discharge current in charging was first set to 70 μA, and a cassette heater (drum heater) in the apparatus was turned OFF. Thereafter, a test chart having an image ratio of 1% was used to perform continuous image formation of 1000 sheets. After completion of the image formation, power feeding to the copier was stopped and the copier was left to stand for 3 days. After such standing for 3 days, power feeding to the copier was again started, and each of a halftone image, a lattice image and a character image (iroha character image) where the Japanese syllabary characters, "iroha", were repeatedly written was output on an A4-landscape-size sheet.

Subsequently, a test chart having an image ratio of 1% was used to perform continuous image formation of 50000 sheets. After completion of the image formation, power feeding to the copier was stopped and the copier was left to stand for 3 days. After such standing for 3 days, power feeding to the copier was again started, and each of a halftone image, a lattice image and a character image (iroha character image) where the Japanese syllabary characters, "iroha", were repeatedly written was output on an A4-landscape-size sheet.

<Evaluation of Image Streaks>

After continuous image formation of 1000 sheets, the halftone image obtained after continuous image formation of 50000 sheets was evaluated as follows. In the present invention, Ranks A and B were determined to sufficiently achieve the suppressive effect on image streaks, and Ranks C and D were determined not to sufficiently achieve the suppressive effect on image streaks.

Rank A: no longitudinal streaks were observed.

Rank B: longitudinal streaks were slightly observed.

Rank C: clear longitudinal streaks occurred on a part of the image.

Rank D: clear longitudinal streaks occurred on the entire surface of the image.

<Evaluation of Image Smearings>

After continuous image formation of 1000 sheets, the lattice image and the iroha character image obtained after continuous image formation of 50000 sheets were evaluated as follows. In the present invention, Ranks A and B were determined to sufficiently achieve the suppressive effect on image smearings, and Ranks C and D were determined not to sufficiently achieve the suppressive effect on image smearings.

Rank A: no image defects were observed on both of the lattice image and the iroha character image Rank B: a part of the lattice image was foggy and a part of the iroha character image was dilute Rank C: the lattice image partially disappeared and the entire surface of the iroha character image was dilute Rank D: the entire surface of the lattice image disappeared and the entire surface of the iroha character image was dilute Image formation was separately performed in the same conditions continuously for 10000 sheets and the potential variation of the electrophotographic photosensitive member was examined. The value "Potential after 10000 sheets−Initial potential" of an image exposure region VL was calculated as ΔVL. In the present invention, when the ΔVL was less than 20 V, the electrophotographic photosensitive member was determined to have no problems about electrical characteristics.

Example 2

An electrophotographic photosensitive member was produced in the same manner as in Example 1 except that exemplary compound (No. 1) was changed to exemplary compound (No. 2), and evaluations of the suppressive effects on image streaks, image smearings and the potential variation after feeding of 10000 sheets were performed.

Example 3

An electrophotographic photosensitive member was produced in the same manner as in Example 1 except that exemplary compound (No. 1) was changed to exemplary compound (No. 3), and evaluations of the suppressive effects on image streaks, image smearings and the potential variation after feeding of 10000 sheets were performed.

Example 4

An electrophotographic photosensitive member was produced in the same manner as in Example 1 except that exemplary compound (No. 1) was changed to exemplary compound (No. 4), and evaluations of the suppressive effects on image streaks, image smearings and the potential variation after feeding of 10000 sheets were performed.

Example 5

An electrophotographic photosensitive member was produced in the same manner as in Example 1 except that the hole transporting compound represented by the formula (F) was changed to a hole transporting compound represented by the following formula (G), and evaluations of the suppressive effects on image streaks, image smearings and the potential variation after feeding of 10000 sheets were performed.

(G)

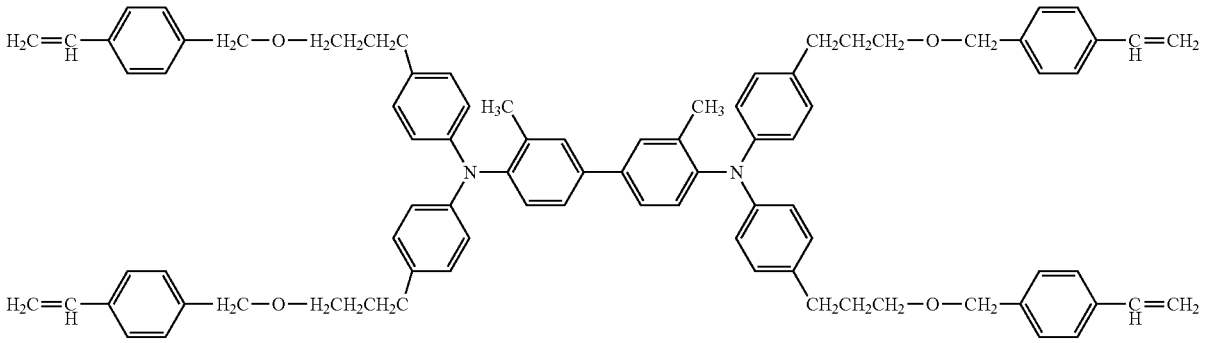

Example 6

An electrophotographic photosensitive member was produced in the same manner as in Example 5 except that exemplary compound (No. 1) was changed to exemplary compound (No. 4), and evaluations of the suppressive effects on image streaks, image smearings and the potential variation after feeding of 10000 sheets were performed.

Example 7

An electrophotographic photosensitive member was produced in the same manner as in Example 1 except that exemplary compound (No. 1) was changed to exemplary compound (No. 11), and evaluations of the suppressive effects on image streaks, image smearings and the potential variation after feeding of 10000 sheets were performed.

Example 8

An electrophotographic photosensitive member was produced in the same manner as in Example 1 except that exemplary compound (No. 1) was changed to a compound represented by the following formula (C-1), and evaluations of the suppressive effects on image streaks, image smearings and the potential variation after feeding of 10000 sheets were performed.

(H)

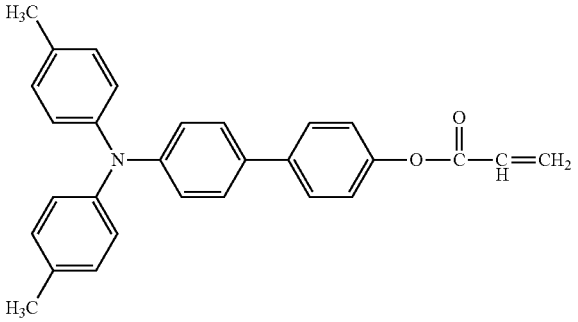

(I)

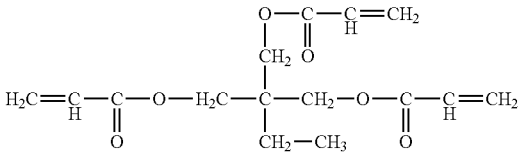

Example 9

An electrophotographic photosensitive member was produced in the same manner as in Example 8 except that exemplary compound (No. 1) was changed to exemplary compound (No. 4), and evaluations of the suppressive effects on image streaks, image smearings and the potential variation after feeding of 10000 sheets were performed.

Comparative Example 1

An electrophotographic photosensitive member was produced in the same manner as in Example 1 except that exemplary compound (No. 1) was changed to a compound represented by the following formula (C-1), and evaluations of the suppressive effects on image streaks, image smearings and the potential variation after feeding of 10000 sheets were performed.

(C-1)

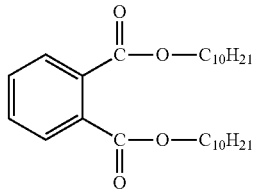

Comparative Example 2

An electrophotographic photosensitive member was produced in the same manner as in Example 1 except that exemplary compound (No. 1) was changed to a compound represented by the following formula (C-2), and evaluations of the suppressive effects on image streaks, image smearings and the potential variation after feeding of 10000 sheets were performed.

(C-2)

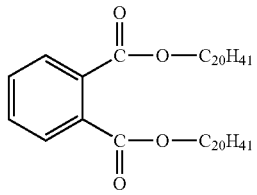

Comparative Example 3

An electrophotographic photosensitive member was produced in the same manner as in Example 1 except that exemplary compound (No. 1) was changed to a compound represented by the following formula (C-3), and evaluations of the suppressive effects on image streaks, image smearings and the potential variation after feeding of 10000 sheets were performed.

(C-3)

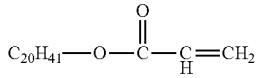

Comparative Example 4

An electrophotographic photosensitive member was produced in the same manner as in Example 1 except that exemplary compound (No. 1) was changed to a compound represented by the following formula (C-4), and evaluations of the suppressive effects on image streaks, image smearings and the potential variation after feeding of 10000 sheets were performed.

(C-4)

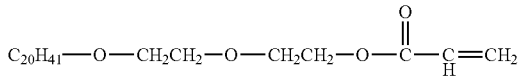

Comparative Example 5

An electrophotographic photosensitive member was produced in the same manner as in Example 1 except that exemplary compound (No. 1) was changed to a compound represented by the following formula (C-5), and evaluations of the suppressive effects on image streaks, image smearings and the potential variation after feeding of 10000 sheets were performed.

(C-5)

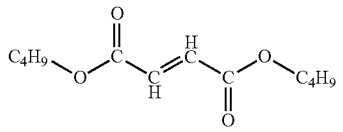

Comparative Example 6

An electrophotographic photosensitive member was produced in the same manner as in Example 1 except that exemplary compound (No. 1) was changed to a compound represented by the following formula (C-6), and evaluations of the suppressive effects on image streaks, image smearings and the potential variation after feeding of 10000 sheets were performed.

(C-6)

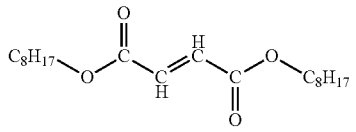

Comparative Example 7

An electrophotographic photosensitive member was produced in the same manner as in Example 1 except that no exemplary compound (No. 1) was used for a coating liquid for a surface layer, and evaluations of the suppressive effects on image streaks, image smearings and the potential variation after feeding of 10000 sheets were performed.

The evaluation results of Examples 1 to 9 and Comparative Examples 1 to 7 are shown in Table 3.

TABLE 3

| | Hole transporting compound | Compound represented by formula (1) | Level of image streaks | | Level of image smearings | | ΔVL (V) after feeding of 10000 sheets |
|---|---|---|---|---|---|---|---|
| | | | After feeding of 1000 sheets | After feeding of 50000 sheets | After feeding of 1000 sheets | After feeding of 50000 sheets | |
| Example 1 | (F) | (No. 1) | B | B | B | B | 6 |
| Example 2 | (F) | (No. 2) | A | B | A | B | 7 |
| Example 3 | (F) | (No. 3) | A | A | A | A | 9 |
| Example 4 | (F) | (No. 4) | A | A | A | A | 13 |
| Example 5 | (G) | (No. 1) | B | B | B | B | 11 |
| Example 6 | (G) | (No. 4) | A | A | A | A | 16 |
| Example 7 | (F) | (No. 11) | A | B | A | B | 8 |
| Example 8 | (H)/(I) | (No. 1) | B | B | B | B | 12 |
| Example 9 | (H)/(I) | (No. 4) | A | A | A | A | 18 |
| Comparative Example 1 | (F) | (C-1) | B | D | B | D | 42 |
| Comparative Example 2 | (F) | (C-2) | A | C | A | C | 55 |
| Comparative Example 3 | (F) | (C-3) | B | B | B | B | 29 |
| Comparative Example 4 | (F) | (C-4) | B | B | B | B | 32 |
| Comparative Example 5 | (F) | (C-5) | C | C | C | C | 7 |
| Comparative Example 6 | (F) | (C-6) | C | C | C | C | 8 |
| Comparative Example 7 | (F) | None | C | D | C | D | 8 |

With respect to each of Comparative Examples 1 to 6, a compound used instead of the compound represented by the formula (1) is shown.

As the results of the evaluations, in each of Examples, the suppressive effects on image streaks and image smearings were sufficiently achieved and the potential variation after feeding of 10000 sheets also had no problem from the initial stage of use (after feeding of 1000 sheets) to the time of repeated use (after feeding of 50000 sheets). In each of Comparative Examples 1 and 2, the suppressive effects on image streaks and image smearings in repeated use were not sufficiently achieved and the potential variation after feeding of 10000 sheets was considerably worsened. In each of Comparative Examples 3 and 4, the potential variation after feeding of 10000 sheets was considerably worsened. In each of Comparative Examples 5 and 6, the suppressive effects on image streaks and image smearings were not sufficiently achieved. In Comparative Example 7, the suppressive effects on image streaks and image smearings were not sufficiently achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-095912, filed May 12, 2017, which is hereby incorporated by reference herein in its entirety.

What is claimed is:

1. An electrophotographic member, comprising:

an electro-conductive support; and a photosensitive layer formed on the electro-conductive support, a surface layer of the electrophotographic photosensitive member comprising a copolymer of a hole transporting compound having a chain-polymerizable functional group and a compound represented by formula (1), the copolymer being obtained by a reaction between the chain-polymerizable functional group and a double bond of the compound represented by formula (1)

(1)

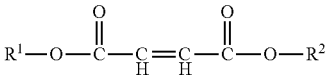

where $R^1$ and $R^2$ individually represent a linear or branched alkyl group having 10 or more carbon atoms.

2. The electrophotographic photosensitive member according to claim 1, wherein the hole transporting compound is represented by the following formula (2)

$$(P^1)_a A \quad (2)$$

where A represents a group including a hole transporting group, a represents an integer of 2 to 4, and $P^1$ independently represents a monovalent functional group including a chain polymerizable functional group represented by following formula formulae (3) or (4) and comprises a binding moiety between A and the chain polymerizable functional group (3)

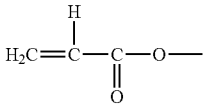

(4)

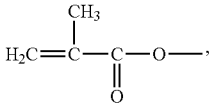

and the binding moiety is represented by formulae (5) or (6) assuming that a binding site of the binding moiety of at which the binding moiety is bound to A is replaced with a hydrogen atom (5)

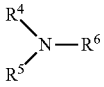

where $R^4$, $R^5$ and $R^6$ independently represent a phenyl group optionally substituted with a $C_{1-6}$ alkyl group and (6)

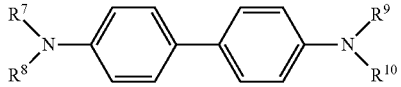

where $R^7$, $R^8$, $R^9$ and $R^{10}$ independently represent a phenyl group optionally substituted with a $C_{1-6}$ alkyl group.

3. The electrophotographic photosensitive member according to claim 1, wherein $R^1$ and $R^2$ independently represent a linear or branched alkyl group having 10 to 19 carbon atoms.

4. A method for producing an electrophotographic photosensitive member comprising an electro-conductive support and a surface layer provided on the electro-conductive support, the method comprising the steps of:

preparing a coating liquid for a surface layer, the coating liquid comprising a hole transporting compound having a chain-polymerizable functional group and a compound represented by formula (1)

(1)

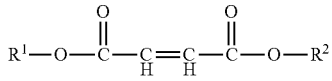

where $R^1$ and $R^2$ independently represent a linear or branched alkyl group having 10 or more carbon atoms;

forming a coating film of the coating liquid on the electro-conductive support; and curing the coating film and forming a copolymer of the hole transporting compound and the compound represented by formula (1) by reacting the chain polymerizable functional group and a double bond of the compound represented by formula (1) to form the surface layer.

5. The method for producing an electrophotographic photosensitive member according to claim 4, wherein the hole transporting compound is represented by formula (2)

$$(P^1)_a A \quad (2)$$

where A represents a group including a hole transporting group, a represents an integer of 2 to 4, and $P^1$ independently represents a monovalent functional group including the chain polymerizable functional group represented by formulae (3) or (4) and comprises a binding moiety between A and the chain polymerizable functional group (3)

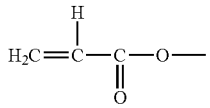

(4)

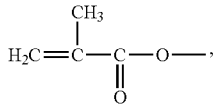

and the binding moiety is represented by formulae (5) or (6) assuming that a binding site of the binding moiety at which the binding moiety is bound to A is replaced with a hydrogen atom (5)

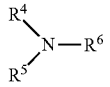

where $R^4$, $R^5$ and $R^6$ independently represent a phenyl group optionally substituted with a $C_{1-6}$ alkyl group and (6)

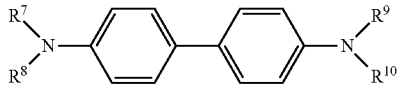

where $R^7$, $R^8$, $R^9$ and $R^{10}$ independently represent a phenyl group optionally substituted with a $C_{1-6}$ alkyl group.

6. The electrophotographic photosensitive member production method according to claim 4, wherein $R^1$ and $R^2$ independently represent a linear or branched alkyl group having 10 to 19 carbon atoms.

7. A process cartridge which integrally supports an electrophotographic photosensitive member, and at least one unit selected from the group consisting of a charging unit, a developing unit, a transfer unit and a cleaning unit, and which is detachably attachable to a main body of an electrophotographic apparatus, the electrophotographic photosensitive member comprising an electro-conductive support and a photosensitive layer provided on the electro-conductive support, a surface layer of the electrophotographic photosensitive member comprising a copolymer of a hole transporting compound having a chain-polymerizable functional group and a compound represented by formula (1), the copolymer being obtained by a reaction between the chain-polymerizable functional group and a double bond of the compound represented by the formula (1)

(1)

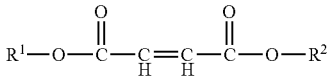

where $R^1$ and $R^2$ individually represent a linear or branched alkyl group having 10 or more carbon atoms.

8. An electrophotographic apparatus, comprising:

an electrophotographic photosensitive member, and a charging unit, an exposure unit, a developing unit and a transfer unit, wherein the electrophotographic photosensitive member comprises an electro-conductive support and a photosensitive layer provided on the electro-conductive support, and a surface layer of the electrophotographic photosensitive member comprises a copolymer of a hole transporting compound having a chain-polymerizable functional group and a compound represented by formula (1), the copolymer being obtained by a reaction between the chain-polymerizable functional group and a double bond of the compound represented by formula (1)

(1)

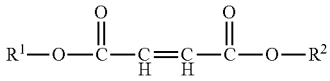

where $R^1$ and $R^2$ individually represent a linear or branched alkyl group having 10 or more carbon atoms.

* * * * *